US006181121B1

(12) United States Patent
Kirkland et al.

(10) Patent No.: US 6,181,121 B1
(45) Date of Patent: Jan. 30, 2001

(54) LOW SUPPLY VOLTAGE BICMOS SELF-BIASED BANDGAP REFERENCE USING A CURRENT SUMMING ARCHITECTURE

(75) Inventors: Brian Kirkland, Austin; Steven Meyers, Round Rock; Bertrand J. Williams, Austin, all of TX (US)

(73) Assignee: Cypress Semiconductor Corp., San Jose, CA (US)

( * ) Notice: Under 35 U.S.C. 154(b), the term of this patent shall be extended for 0 days.

(21) Appl. No.: 09/262,430

(22) Filed: Mar. 4, 1999

(51) Int. Cl.[7] ..... G05F 3/20
(52) U.S. Cl. ..... 323/313; 323/314; 323/907
(58) Field of Search ..... 323/313, 315, 323/312, 907, 314

(56) References Cited

U.S. PATENT DOCUMENTS 3,781,648 * 12/1973 Owens ..... 323/313
4,450,367 5/1984 Whatley ..... 307/297
4,849,684 7/1989 Sonntag et al. ..... 323/313
4,935,690 6/1990 Yan ..... 323/314
5,049,806 * 9/1991 Urakawa et al. ..... 323/314
5,451,860 9/1995 Khayat ..... 323/314
5,559,425 9/1996 Allman ..... 323/315

* cited by examiner

*Primary Examiner*—Peter S. Wong
*Assistant Examiner*—Rajnikant B. Patel
(74) *Attorney, Agent, or Firm*—Christopher P. Maiorana, P.C.

(57) ABSTRACT

An apparatus comprising a first circuit, a second circuit and a third circuit. The first circuit may be configured to generate a first current in response to a reference voltage. The first current may vary as a function of temperature. The second circuit may be configured to generate a second current to counteract for the variations of the first current. The second current may vary as a function of temperature. The third circuit may be configured to generate a third current in response to the first current and the second current.

17 Claims, 5 Drawing Sheets

LOW SUPPLY VOLTAGE BICMOS SELF-BIASED BANDGAP REFERENCE USING A CURRENT SUMMING ARCHITECTURE

FIELD OF THE INVENTION

The present invention relates to bandgap reference circuits generally and, more particularly, to a bandgap reference circuit that may operate at low supply voltages and may use a BiCMOS process.

BACKGROUND OF THE INVENTION

Conventional bandgap reference circuits generally develop a constant reference voltage and may use an operational amplifier to cause currents to be equal or to cause certain voltages to be equal. Additionally, conventional bandgap reference circuits may generate a bandgap voltage and then translate the bandgap voltage into a current.

FIG. 1 illustrates one conventional bandgap voltage circuit. An operational amplifier 12 generally forces its inputs to be equal. However, the implementation of the operational amplifier 12 generally limits headroom. The operational amplifier 12 generally requires extra circuitry to maintain stability in the feedback loops. FIG. 1 is generally limited to generating a current that is proportional to absolute temperature (PTAT).

FIG. 2 illustrates a conventional bandgap circuit that can be found in U.S. Pat. No. 4,849,684. The circuit of FIG. 2 is generally limited to generating a current that is proportional to absolute temperature.

FIG. 3 illustrates a conventional bandgap circuit that can be found in U.S. Pat. No. 5,559,425. The circuit of FIG. 3, similar to the circuits of FIGS. 1 and 2, is generally limited to generating a current that is proportional to absolute temperature.

FIG. 4 illustrates a bandgap circuit that can be found in U.S. Pat. No. 4,935,690. The circuit of FIG. 4 is generally limited to presenting either a voltage output, or a current that is proportional to absolute temperature.

FIG. 5 illustrates a bandgap circuit that can be found in U.S. Pat. No. 4,450,367. The circuit of FIG. 5 is generally limited to generating a current that is proportional to absolute temperature.

FIG. 6 illustrates a conventional bandgap circuit that can be found in U.S. Pat. No. 5,451,860. The circuit of FIG. 6 is generally limited to generating a voltage output.

SUMMARY OF THE INVENTION

The present invention concerns an apparatus comprising a first circuit, a second circuit and a third circuit. The first circuit may be configured to generate a first current in response to a reference voltage. The first current may vary as a function of temperature. The second circuit may be configured to generate a second current to counteract for the variations of the first current. The second current may vary as a function of temperature. The third circuit may be configured to generate a third current in response to the first current and the second current.

The objects, features and advantages of the present invention include providing a bandgap reference circuit that may (i) not require an operational amplifier which may limit headroom, (ii) directly generate currents (iii) minimize the need for extra circuitry to maintain stability in a feedback loop, (iv) provide a simple modular design, (v) provide a PTAT current, an inverse PTAT current, or combination of both currents as outputs, and/or (vi) provide a low voltage operation (e.g., may operate down to 2.1 volts or lower across all process corners).

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

This present invention may provide a bandgap reference circuit that may generate bias currents that may be needed for CML logic operations. The present invention may generate (i) a first current based on the difference between two bipolar-junction transistor (BJT) base-emitter junctions biased at different current densities, which is generally proportional to temperature and (ii) a second current based on a single base-emitter junction voltage, which is generally inversely proportional to temperature. The present invention may then sum the first and second currents together to generate a final current that may vary only inversely proportional to resistance. The final current may then be used in Current Mode Logic (CML) or other analog applications to develop a constant voltage.

Figure 1:
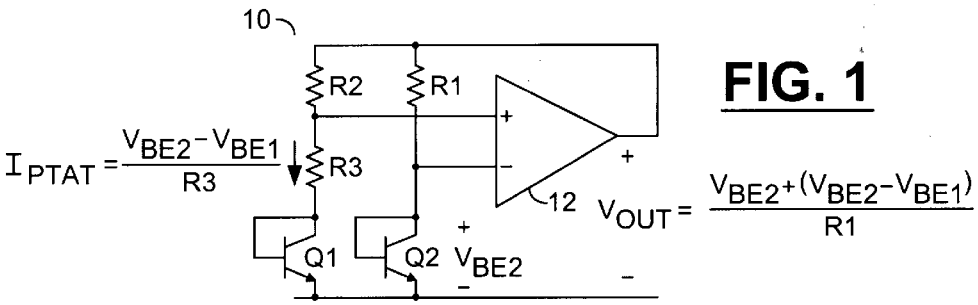
FIGS. 1–6 illustrate conventional bandgap reference circuits.
Figure 2:
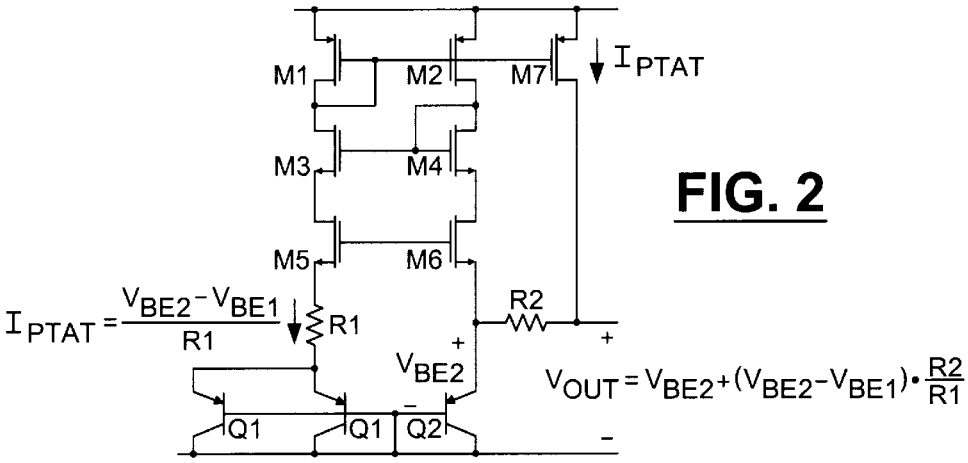
Figure 3:
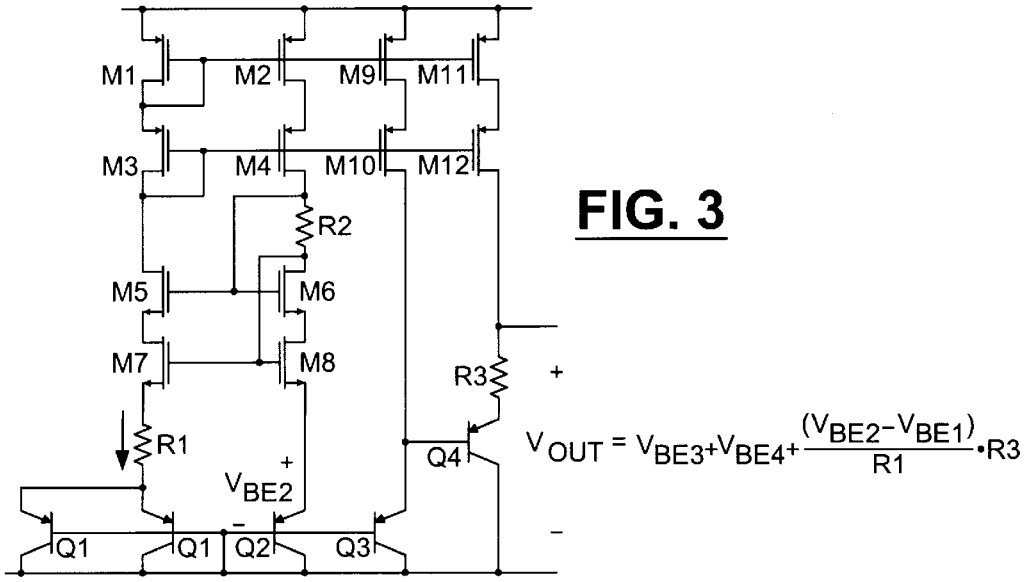
Figure 4:
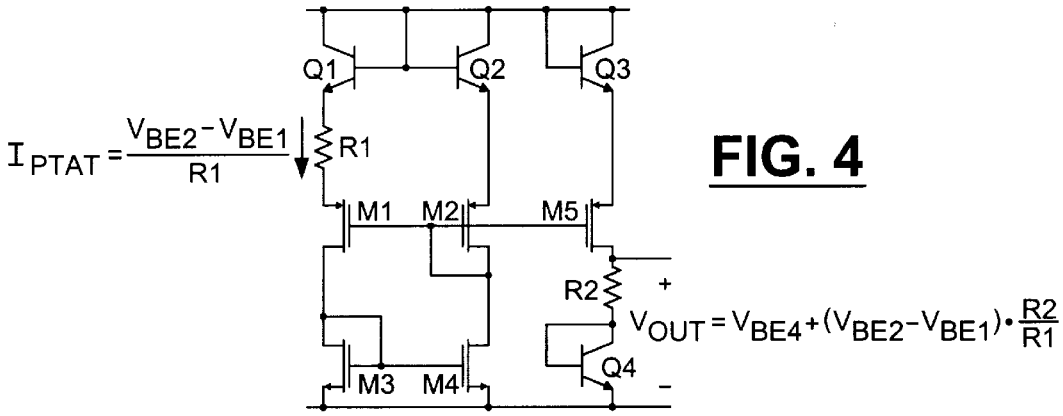
Figure 5:
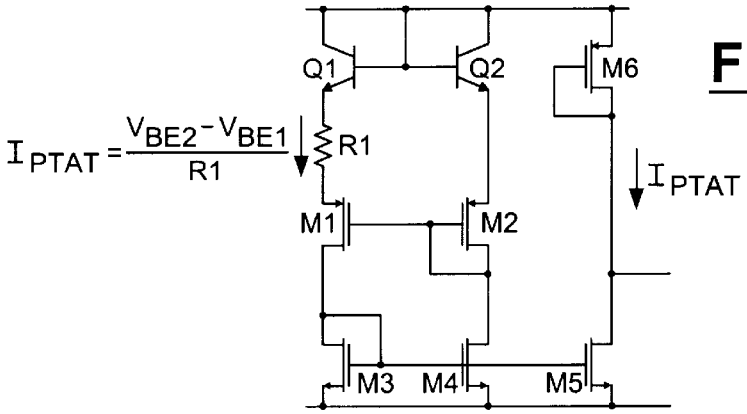
Figure 6:
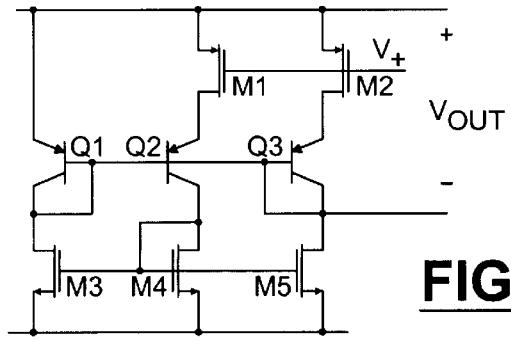
Figure 7:
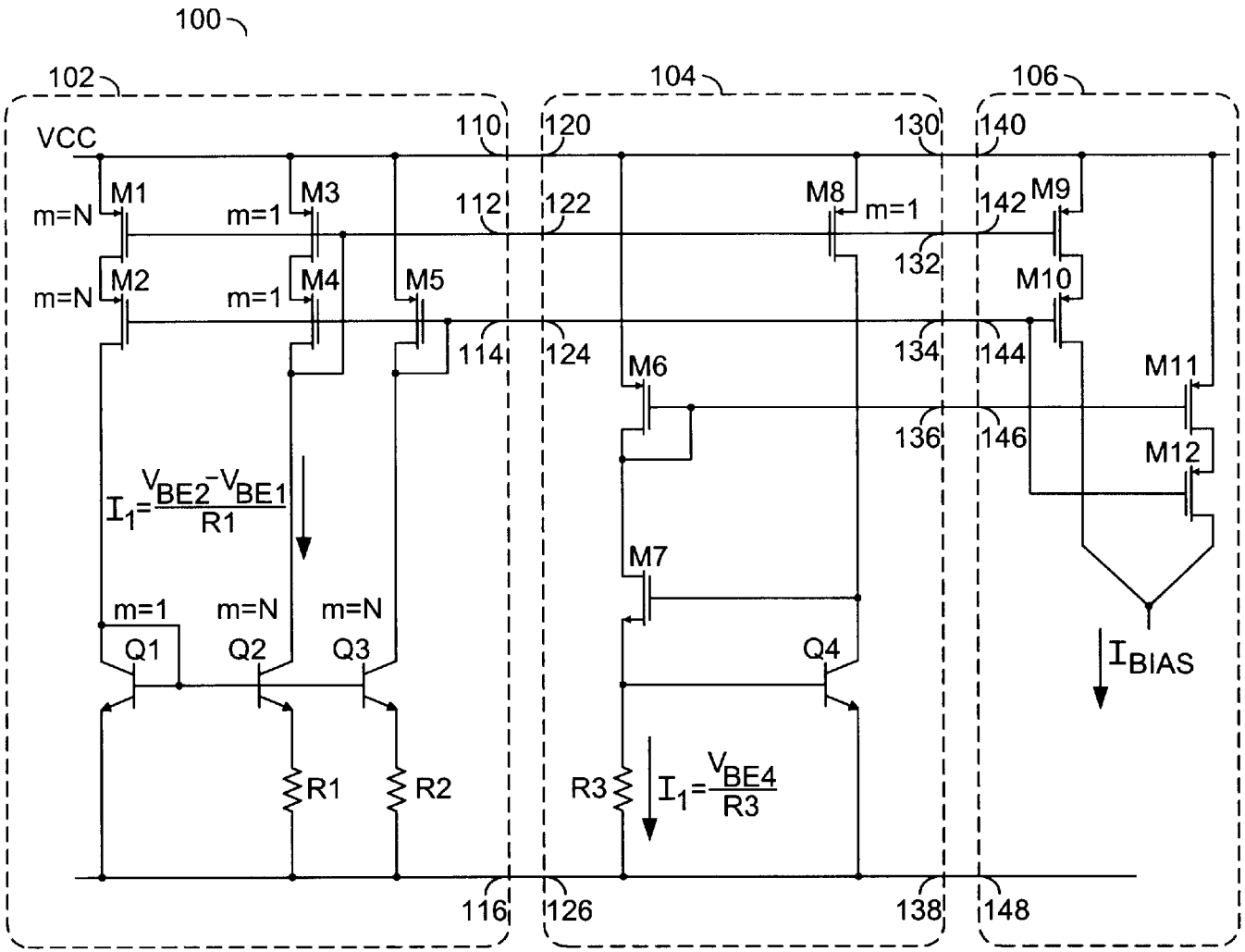
FIG. 7 illustrates a preferred embodiment of the present invention.

Referring to FIG. 7, a circuit 100 is shown in accordance with a preferred embodiment of the present invention. The circuit 100 generally comprises a current generator block (or circuit) 102, a current generator block (or circuit) 104 and a current summing block (or circuit) 106. The circuit 102 generally comprises a transistor M1, a transistor M2, a transistor M3, a transistor M4, a transistor M5, a transistor Q1, a transistor Q2, a transistor Q3, a resistor R1 and a resistor R2. The transistors Q1, Q2 and Q3 may be implemented as bipolar-junction transistors and the transistors M1–M5 may be implemented as CMOS transistors. The circuit 102 generally comprises an output 110, an output 112, an output 114 and an output 116 that may be presented to an input 120, an input 122, an input 124 and an input 126, respectively.

The circuit 104 generally comprises a transistor M6, a transistor M7, a transistor M8, a transistor Q4 and a resistor R3. The circuit 104 generally comprises an output 130, an output 132, an output 134, an output 136 and an output 138 that may be presented to an input 140, an input 142, an input 144, an input 146 and an input 148, respectively. The circuit 106 generally comprises a transistor M9, a transistor M10, a transistor M11, and a transistor M12.

The transistors M3, M4, M8 and Q1 are shown having a sizing reference of m=1. The transistors M1, M2, Q2 and Q3 are shown with a sizing reference of m=N. The legend m=N generally indicates that the transistors M2, Q2 and Q3 have a size that may be an integer (or integer fraction) multiple greater than the size of the transistors with the reference m=1. In one example, the transistors Q2 and Q3 may be four times the size of the transistor Q1. However, other multiples may be implemented accordingly to meet the design criteria of a particular implementation. For example, a sizing of 2×–5×, 1.5×–10×, or other sizing may be appropriate for a particular design application.

The circuit 102 may develop a voltage (e.g., V1) based on the voltage difference of the base-emitter junctions of the transistors Q1 and Q2, which are generally biased at different current densities. The voltage V1 may be impressed across the resistor R1 (and/or R2) to generate a current (e.g. I1), which may be proportional to temperature changes. The current I1 may be defined by the following equation:

$$I1=(Vbe1-Vbe2)/R1 \quad \text{EQ1}$$

The circuit 104 may develop a voltage (e.g., V2) based on the base-emitter junction voltage of the transistor Q4 which may be inversely proportional to temperature. The voltage V2 may be impressed upon the resistor R3 to develop a current (e.g., I2) that may vary inversely proportional to temperature. The current I2 may be defined by the following equation:

$$I2=Vbe4/R3 \quad \text{EQ2}$$

The currents I1 and I2 may be summed (i.e., added) together by the circuit 106 to generate an output current (e.g., Ibias). The current Ibias may be defined by the following equation:

$$Ibias=(Vbe1-Vbe2)/R1+Vbe4/R3 \quad \text{EQ3}$$

If the current Ibias may flow through a resistor Rext (not shown) of the same type as the resistors R1, R2 and R3, a voltage across the resistor Rext may be generated that may be constant with respect to process, voltage or temperature changes.

Figure 8:
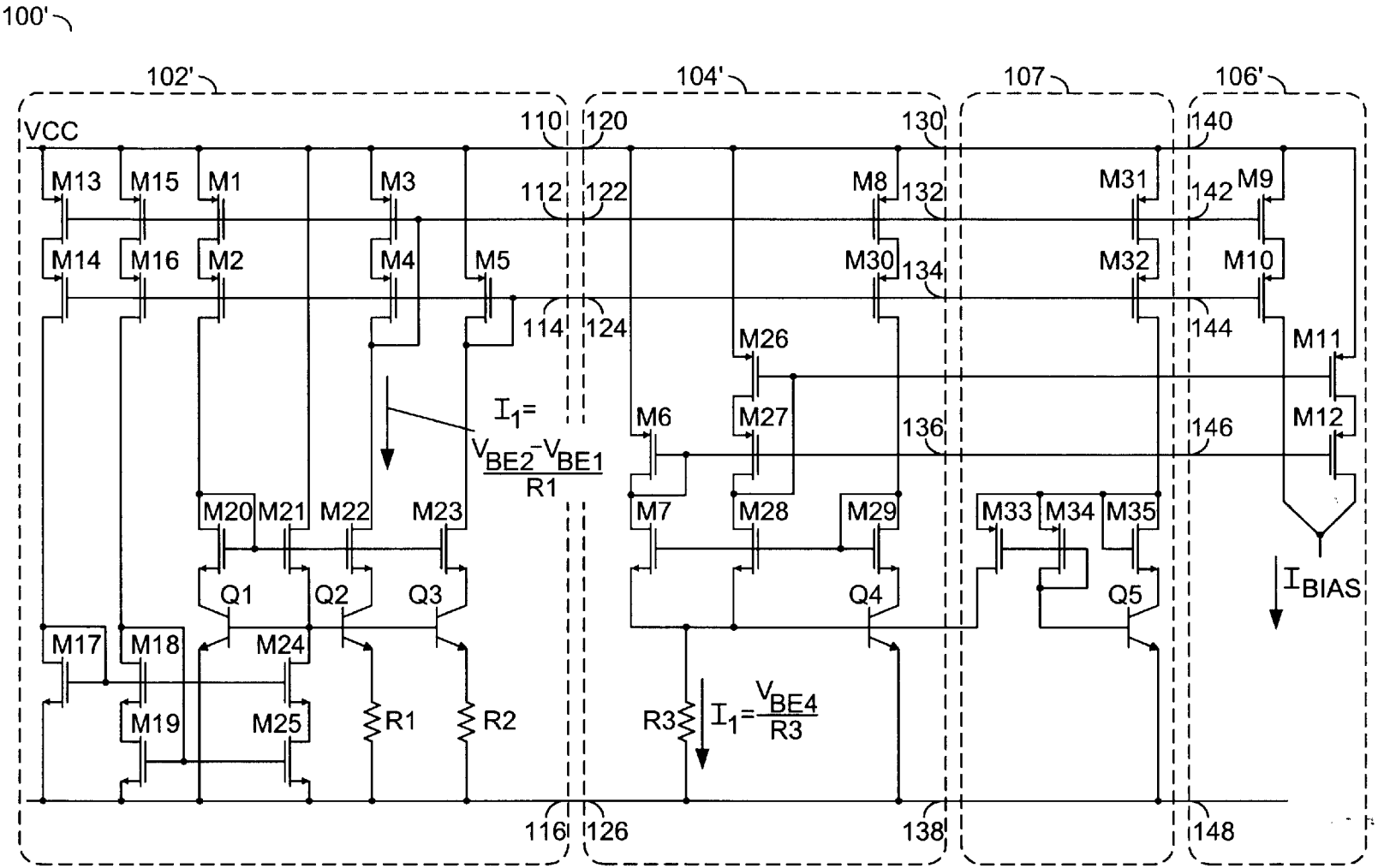
FIG. 8 illustrates an alternate embodiment of the present invention.

Referring to FIG. 8, a circuit 100' is shown in accordance with an alternate embodiment to the present invention. The circuit 100' adds additional transistors to the block 102', the block 104' and the block 106'. Additionally, a cancellation circuit 107 is shown. The block 102' is shown further comprising additional transistors M13, M14, M15, M16, M17, M18, M19, M20, M21, M22, M23, M24 and M25.

The block 104' is shown comprising additional transistors M26, M27, M28, M29 and M30. The base current cancellation circuit 107 is shown comprising a transistor M31, M32, M33, M34, M35 and the transistor Q5. The base current cancellation circuit 107 provides additional filtering of the currents. The current summer circuit 106' shows the transistors M11 and M12 having gates controlled by the transistors M26 and M6, respectively.

The circuit 100' may provide several enhancements when compared with the circuit 100. The current I1 and the current I2 are shown having an independent cascode transistor (e.g., the transistor M12) in the summer circuit 106'. The block 102' and the block 104' are generally fully cascoded to ground and to the supply voltage VCC.

Figure 9:
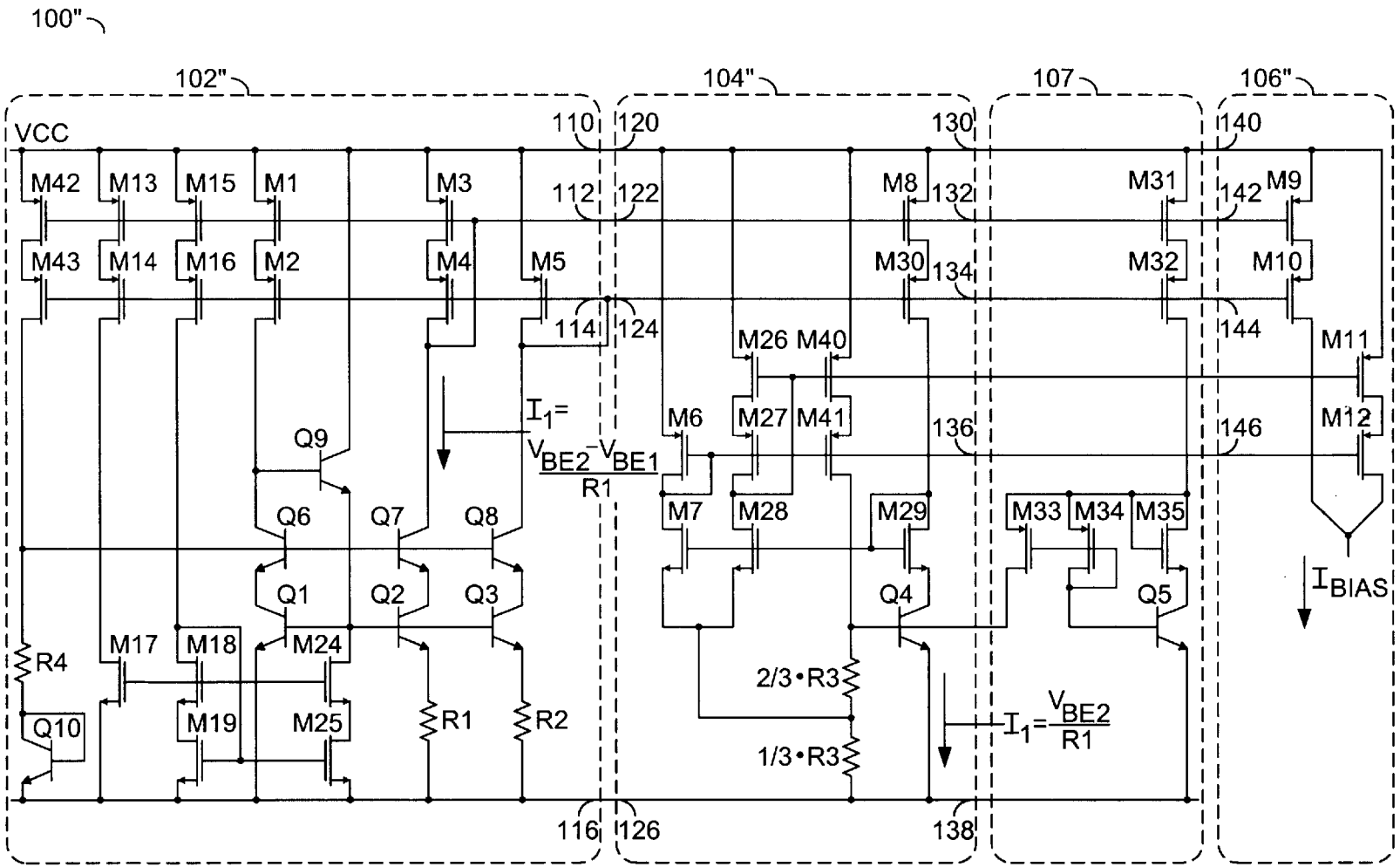
FIG. 9 illustrates another alternate embodiment of the present invention.

Referring to FIG. 9, another alternate circuit 100" is shown. The block 102" is shown further comprising transistors Q6, Q7, Q8, Q9, Q10, transistors M42 and M43, and resistor R4. The current generation section 104" is shown further comprising additional transistors M40 and M41.

The circuit 100" may provide an implementation of the present invention that may work with low power supplies (e.g., as low as 2.1 v or lower). This circuit 100" may also provide a number of enhancements compared with the circuits 100 and 100'. For example, the transistors Q6, Q7 and Q8 may replace corresponding MOSFET transistors (e.g., M20, M22, M23) shown in the circuit 100'. The transistors Q6, Q7 and Q8 may be implemented in one example, as NPN transistors. The transistors Q6, Q7 and Q8 may allow more headroom since their base to emitter voltage Vbe is generally less than the gate to source voltage Vgs of a MOSFET transistor and since MOSFET transistors generally have a high threshold voltage Vt.

The resistor R3 is shown split into thirds. Splitting the resistor R3 may allow a choice of where to inject the current I2 from the top of the resistor R3 to a point one-third of the way up the resistor R3 from ground. Such a configuration may allow more headroom in transistors M6 and M26.

The transistor Q9 may supply a base current to the transistors Q1, Q2 and Q3. The resistor R4 and the transistor Q10 may bias the transistors Q6, Q7 and Q8, which may leave the transistors Q1, Q2 and Q3 with collector to emitter voltages Vce slightly above the collector to emitter saturation voltage Vce (SAT) (e.g., ≅0.2 v). The voltage Vbe of the transistor Q10 generally matches the voltage Vbe of the transistors Q6, Q7 and Q8. The voltage across the resistor R4 will generally determine the collector to emitter voltage Vce of the transistors Q1, Q2 and Q3. The voltage Vce may be enough to avoid saturating the transistors Q1, Q2 or Q3 across all corners, voltages and temperatures.

The circuit 100" may provide the temperature stability as in the circuit 100, but may also enable operation with lower power supplies (e.g., as low as 2.1 v or lower). While the present invention has been described in the context of various embodiments, each of the circuits 100, 100', 100" may be used to develop a current that changes only in response to changes in resistance.

While the invention has been particularly shown and described with reference to the preferred embodiments thereof, it will be understood by those skilled in the art that various changes in form and details may be made without departing from the spirit and scope of the invention.

What is claimed is:

1. An apparatus comprising:

a first circuit configured to generate a first current in response to a reference voltage, wherein said first current varies as a function of temperature;

a second circuit configured to generate a second current configured to counteract for the variation of said first current, wherein said second current varies as a function of temperature; and a third circuit configured to generate a third current in response to said first current and said second current comprising a first and second transistor, where a drain of said first transistor is coupled to a drain of said second transistor.

2. The apparatus according to claim 1, further comprising a fourth circuit configured to provide base current cancellation on said second circuit.

3. The apparatus according to claim 1, wherein said third current is presented to a current mode logic (CML) circuit.

4. The apparatus according to claim 1, wherein said first current is a proportional to absolute temperature (PTAT) current.

5. The apparatus according to claim 1, wherein said second current is an inverse proportional to absolute temperature (PTAT) current.

6. The apparatus according to claim 1, further comprising an output equal to said first current, said second current, or said third current.

7. The apparatus according to claim 1, wherein said first circuit generates said first current in further response to a third transistor having a first base-emitter junction biased at a first current density and a fourth transistor having a second base-emitter junction biased at a second current density, wherein said first and second current densities are different.

8. The apparatus according to claim 1, wherein said first circuit generates said first current in further response to a first resistor.

9. The apparatus according to claim 8, wherein said first circuit generates said first current further comprising a sixth transistor and a second resistor.

10. The apparatus according to claim 9, wherein said second circuit generates said second current in further response to a fifth transistor having a third base- emitter junction voltage.

11. A method for generating an output current that varies as a function of resistance, comprising the steps of:

(A) generating a first current in response to a reference voltage, wherein said first current varies as a function of temperature;

(B) generating a second current to counteract for said current variations, wherein said second current varies as a function of temperature; and (C) generating said output current in response to said first current and said second current, wherein said output current is configured from a first and second transistor, where a drain of said first transistor is coupled to a drain of said second transistor.

12. The method according to claim 11, further comprising:

canceling a base current prior to step (C).

13. The method according to claim 11, wherein said first current is a proportional to absolute temperature (PTAT) current.

14. The method according to claim 11, wherein said second current is an inverse proportional to absolute temperature (PTAT) current.

15. The apparatus according to claim 1, wherein said first current is generated independently of said second current.

16. The method according to claim 11, wherein said first current is generated independently of said second current.

17. An apparatus comprising:

a first circuit configured to generate a first current in response to a reference voltage, wherein said first current varies as a function of temperature and is coupled to ground through a first resistor;

a second circuit configured to generate a second current configured to counteract for the variation of said first current, wherein said second current varies as a function of temperature and is coupled to ground through a second resistor; and a third circuit configured to generate a third current in response to said first current and said second current, wherein said third current varies as a function of resistance.

* * * * *